US007198168B2

(12) United States Patent
Mizuma

(10) Patent No.: US 7,198,168 B2
(45) Date of Patent: Apr. 3, 2007

(54) CAN

(75) Inventor: Jyunzi Mizuma, 16-14, Kashiidai 1-chome, Higashi-ku, Fukuoka-shi, Fukuoka-ken (JP)

(73) Assignees: Jyunzi Mizuma, Fukuoka-shi (JP); Yoshito Komatsu, Tagawa-shi (JP); Hirosi Funatu, Fukuoka-shi (JP); Yutaka Nakao, Fukuoka-shi (JP); Koichi Tanaka, Fukuoka-shi (JP); Kenichi Shinohara, Fukoka-shi ( * ) Notice: Subject to any disclaimer, the term of this patent is extended or adjusted under 35 U.S.C. 154(b) by 360 days.

(21) Appl. No.: 10/837,713

(22) Filed: May 4, 2004

(65) Prior Publication Data

US 2005/0115969 A1 Jun. 2, 2005

(30) Foreign Application Priority Data

Nov. 27, 2003 (JP) ..... P2003-397585

(51) Int. Cl.
*B65D 17/34* (2006.01)
*B65D 43/18* (2006.01)

(52) U.S. Cl. ..... 220/269; 220/906; 220/254.4; 220/253; 220/719; 220/730; 220/821

(58) Field of Classification Search ..... 220/269, 220/254.4, 253, 372, 820, 821, 824, 719, 220/730, 906; 215/236; 222/557
See application file for complete search history.

(56) References Cited

U.S. PATENT DOCUMENTS 1,180,913 A * 4/1916 Foss ..... 220/254.4
4,537,326 A * 8/1985 Morehead ..... 220/269
4,681,238 A * 7/1987 Sanchez ..... 220/260
4,834,258 A * 5/1989 Root ..... 220/269
5,379,914 A * 1/1995 Martins ..... 220/719

(Continued)

FOREIGN PATENT DOCUMENTS

| | | |
|---|---|---|
| JP | 5-7632 | 2/1993 |
| JP | 8-104327 | 4/1996 |
| JP | 3027910 | 8/1996 |
| JP | 8-244770 | 9/1996 |
| JP | 8-318944 | 12/1996 |
| JP | 3052836 | 10/1998 |

*Primary Examiner*—Anthony D. Stashick
*Assistant Examiner*—James Smalley
(74) *Attorney, Agent, or Firm*—Wenderoth, Lind & Ponack, L.L.P.

(57) ABSTRACT

A can (1) having a spout that can, after opening, be securely resealed and can be opened and closed with an easy operation. The can (1) has a spout (3) that is opened by lifting and pulling a pull-ring (6) fixed on a top wall (2) of a can body (1*a*) with a rivet (5) to bend a sealing tongue portion (4) toward the inside of the can. Inside the top wall (2) and away from the spout (3), an internal sealing member (7) having a fan shape with its pivot mounted to the rivet and a size capable of sealing the spout (3) is disposed so as to be fixed to the rivet (5). After opening the spout (3), by rotating the pull-ring (6) around the rivet (5), the internal sealing member (7) is also rotated at the same time. As an interlocking mechanism therefor, the rivet (5) is rotatably supported by the top wall (2), and a base end of the pull-ring (6) and the pivot of the internal sealing member (7) are fixed to the rivet (5), respectively.

14 Claims, 18 Drawing Sheets

U.S. PATENT DOCUMENTS 5,617,920 A * 4/1997 Dovan et al. ..... 166/295
5,775,534 A * 7/1998 Webb et al. ..... 220/269
5,845,801 A * 12/1998 Heitl ..... 220/269
6,588,617 B1 * 7/2003 Majcen et al. ..... 220/254.4
6,626,314 B1 * 9/2003 McHenry et al. ..... 220/254.2
6,755,315 B1 * 6/2004 Mueller ..... 220/254.4
2001/0032852 A1 * 10/2001 Naude ..... 220/258
2005/0051553 A1 * 3/2005 Li et al. ..... 220/254.4

* cited by examiner

CAN

BACKGROUND OF THE INVENTION

1. Field of the Invention

The present invention relates to a can with a pull-ring opener, which is used as a container for beverages such as soft drinks, beer and the like.

2. Description of the Related Art

A can with a pull-ring opener has a spout that can be easily opened by lifting and pulling a pull-ring (or pull top, pull tab) pivotally supported by a rivet on a top wall of the can. Recently, such type of can has been widely used as containers for beverages such as soft drinks, beer and the like.

On the other hand, a spout of a can with a conventional pull-ring opener, once it is opened, is no longer reclosable, which causes inconvenience if the entire contents have not been consumed at once.

In view of the above, cans provided with sealing members that can reclose spouts once opened have been disclosed in some publications such as Unexamined Japanese Utility Model Publication No. 5-7632, Unexamined Japanese Patent Publication No. 8-244770 and U.S. Pat. No. 4,681,238.

The can described in Unexamined Japanese Utility Model Publication No. 5-7632 has an outer sealing plate disposed on an outer surface of a top wall of a can for sealing a spout once opened. Due to this structure, if the can is used for carbonated beverages such as beer or soda, which generate carbon dioxide inside the can that has been opened, a pressure in the can increased by carbon dioxide creates a gap between the top wall and the outer sealing plate, which may deteriorate the sealing function. Furthermore, as the outer sealing plate has substantially the same size as the top wall, a large amount of material is required for producing the can, and also the weight of the can itself is increased.

In the can described in Unexamined Japanese Patent Publication No. 8-244770, as a stopper for sealing an opened spout is made of materials such as gum, flexible plastic, vinyl and styrene foam, the can is expected to have high airtightness. However, due to the structure that the spout is sealed from an outside of a top wall, a pressure inside the can increased by carbon dioxide may push up the stopper and create a gap to allow the carbon dioxide to gradually leak through the gap. Moreover, the stopper made of materials such as gum, plastic or the like, which are different from metallic materials composing the can, makes the manufacturing process of the can complex and, when recycling the used can, the stopper made of alien materials would cause various problems including the necessity to classify the members depending on the materials.

In the re-closure device for containers disclosed in U.S. Pat. No. 4,681,238, after a pull-ring fixed to a top lid with a rivet is raised to expose a lid opening, the pull-ring is rotated about the rivet in that state so that a resealing member disposed on an inner side of the top lid rotates about the rivet to seal the lid opening. In this device, the resealing member having a similar shape to the opening tends to create a gap unless the opening and the resealing member are exactly overlaid. Thus, the opening cannot be sealed in a secure manner. Particularly, after opening a can with a pull-ring opener, as a sealing lobe is bent down into the interior of the can from an area around the rivet, rotation of the resealing member about the rivet is stopped by abutting against the bent sealing lobe, thereby failing to seal the opening completely.

On the other hand, a container made from a used can with a pull-ring opener provided with a function of closing a spout has been disclosed, for example, in Japanese Utility Model Registration No. 3052836.

In the closable container made from a used can described in Japanese Utility Model Registration No. 3052836, a rotating cover for reclosing the spout is attached after the can has been used. Therefore, as a container for liquids, the can hardly has sufficient tightness. In addition, as the rotating cover has a form of a relatively thin plate and is tightly attached to an outer surface of a top wall, it is difficult to manipulate the cover to open and close the spout.

An object of the present invention is to provide a can in which a spout after the can has been opened is securely sealed and also can be opened and closed with an easy operation.

SUMMARY OF THE INVENTION

The first structure of a can according to the present invention is, in a can with a spout which is opened by lifting and pulling a pull-ring fixed on a top wall of the can with a rivet to bend a sealing tongue portion toward an inside of the can, the can comprising an internal sealing member which has a fan shape with a pivot mounted to the rivet and a size capable of sealing the spout, the internal sealing member being fixed to the rivet and disposed on a position inside the top wall and away from the spout, and an interlocking mechanism to rotate the internal sealing member at the time when the pull-ring is rotated around the rivet after the spout is opened.

In the above structure, after a pull-ring is lifted and pulled to open a spout by a normal action of opening a can, the pull-ring is rotated around a rivet, thereby also rotating an internal sealing member at the same time. Thus, when rotating the internal sealing member up to a position right beneath the spout, the once opened spout can be reclosed. The internal sealing member having a fan shape with a pivot mounted to the rivet is formed to expand from the rivet. Therefore, by rotating the internal sealing member up to a position abutting against a sealing tongue portion bent toward an inside of the can, the spoutn is completely sealed. As the internal sealing member seals the spout from an inner side of the top wall, contents of the can does not spill out if the can drops. In addition, by sealing the spout with the internal sealing member, heat exchange between the inner and outer sides of the can is hindered to control a temperature change of the contents of the can. Accordingly, cold contents can be kept cold, and hot contents kept hot for a relatively long time.

If a pressure inside the can is increased due to carbon dioxide generated from the contents, the internal sealing member is pressed against the spout to increase airtightness. Therefore, the spout after opening can be securely resealed, and loss of carbon dioxide from drinks can be prevented. Furthermore, only by rotating the pull-ring around the rivet after opening the spout, can the spout be closed and opened, which facilitates opening/closing operations.

As an interlocking mechanism to rotate the internal sealing member at the time when the pull-ring is rotated around the rivet after the spout is opened, a mechanism such that, after opening the spout, the rivet is rotatably supported by the top wall, and the pull-ring and the internal sealing member are fixed to the rivet on outer and inner sides of the top wall, respectively, can be employed. With this structure, the pull-ring, the rivet and the internal sealing member are integrated so that the internal sealing member can be rotated in conjunction with the pull-ring rotated around the rivet after the spout is opened.

Next, the second structure of the can according to the present invention is, in a can with a spout which is opened by lifting and pulling a pull-ring fixed to a projection formed on a top wall of the can to bend a sealing tongue portion toward an inside of the can, the can comprising an internal sealing member which has a size capable of sealing the spout, the internal sealing member being fixed to the projection and disposed on a position inside the top wall and away from the spout, and an interlocking mechanism to rotate the internal sealing member at the time when the pull-ring is rotated around the projection after the spout is opened.

In the above structure, after a pull-ring is lifted and pulled to open a spout by a normal action of opening a can, the pull-ring is rotated around a projection, thereby also rotating an internal sealing member at the same time. Thus, when rotating the internal sealing member up to a position right beneath the spout, the once opened spout can be reclosed. As the internal sealing member seals the spout from an inner side of the top wall, the contents of the can do not spill out if the can drops. In addition, by sealing the spout with the internal sealing member, heat exchange between the inner and outer sides of the can is hindered to control a temperature change of contents of the can. Accordingly, cold contents can be kept cold, and hot contents kept hot for a relatively long time.

If a pressure inside the can is increased due to carbon dioxide generated from the contents, the internal sealing member is pressed against the spout to increase airtightness. Therefore, the spout after opening can be securely resealed, and loss of carbon dioxide from carbonated drinks can be prevented. Furthermore, only by rotating the pull-ring around the projection after opening the spout, can the spout be closed and opened, which facilitates opening/closing operations. As a means for fixing the pull-ring and the internal sealing member to the top wall, any rivet that penetrates the top wall is not used, thereby keeping good airtightness also before opening the can.

As the above-described interlocking mechanism, preferably, a thin-walled portion having a form of a closed curve that encircles the projection and is torn when opening the spout may be formed on the top wall. In this structure, the thin-walled portion encircling the projection is torn by opening the spout, and then the projection can be rotated in conjunction with the pull-ring and the internal sealing member integrally. Therefore, the internal sealing member is rotated concurrently with rotating the pull-ring around the projection after the spout is opened.

In this case, it is further preferable to form, on an area of the top wall between the thin-walled portion around the projection and the sealing tongue portion, at least one selected from a convex portion extending toward an outer side of the top wall and a concave portion extending toward an inner side of the top wall. This structure enhances rigidity of the area of the top wall between the thin-walled portion and the sealing tongue portion. Thus, a stress is concentrated on the thin-walled portion to certainly break the thin-walled portion that should be torn, which facilitates an opening operation. Preferably, a plurality of the convex portions may be formed between the thin-walled portion and the sealing tongur portion.

In the can according to the present invention, the internal sealing member is formed in a fan shape with a pivot on the rivet or the projection. This form does not disturb an operation of opening the spout and, after opening the can, the spout can be securely sealed simply by rotating the pull-ring.

It is also preferable to make the internal sealing member of substantially the same material as a material of a can body. With this structure, the internal sealing member can be mounted in a process similar to a conventional process for manufacturing a can. Thus, the manufacturing process is kept from becoming complex. Upon recycling a used can, it is no longer necessary to separate the internal sealing member from the can body during the collecting process, keeping the collecting operations from being troublesome.

Here, "to make the internal sealing member of substantially the same material as a material of a can body" does not mean that even the ingredients and composition of the material for the internal sealing member and the can body should be completely the same, but means that the degree of sameness may include the cases where the can body and the internal sealing member are both made of alumina or alumina base alloy, or they are both made of steel or steel base alloy, or the like.

BRIEF DESCRIPTION OF THE DRAWINGS

In the accompanying drawings:

FIGS. 1 to 4 are drawings showing a first embodiment of the present invention, wherein FIG. 1 is a plan view showing a can according to the first embodiment of the present invention;

FIG. 2 is a partially cut-out sectional view taken along the line A—A of FIG. 1;

FIG. 3 is a partially cut-out sectional view illustrating the can shown in FIG. 2 in an open state; and FIG. 4 is a plan view illustrating a state that an opened spout of the can shown in FIG. 1 is closed by an internal sealing member.

FIGS. 5 to 13 show a second embodiment of the present invention, wherein FIG. 5 is a partial perspective view showing a can according to the second embodiment of the present invention;

FIG. 6 is a partially omitted perspective sectional view taken along the line B—B of FIG. 5;

FIG. 7 is an enlarged view of a part of FIG. 6;

FIG. 8 is an enlarged view of a part of FIG. 7;

FIG. 9 is a perspective view illustrating a top wall which constitutes the can shown in FIG. 5 before assembly;

FIG. 10 is a developed perspective view illustrating the part shown in FIG. 7 after assembly;

FIG. 11 is a partial perspective view illustrating the can shown in FIG. 5 in an open state;

FIG. 12 is a partially omitted perspective sectional view taken along the line B—B of FIG. 10; and FIG. 13 is an enlarged view of a part of FIG. 12.

DETAILED DESCRIPTION OF THE PREFERRED EMBODIMENT

FIGS. 1 to 4 are drawings showing a first embodiment of the present invention.

Figure 1:
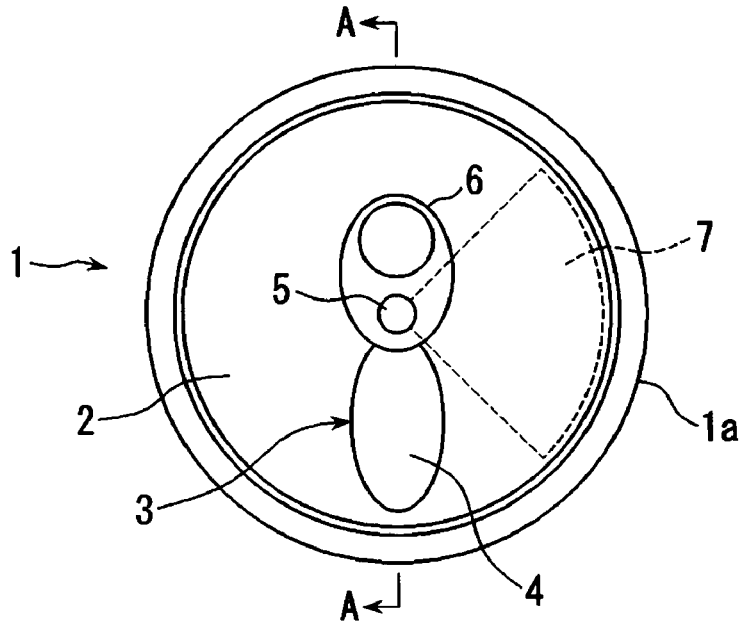
Figure 2:
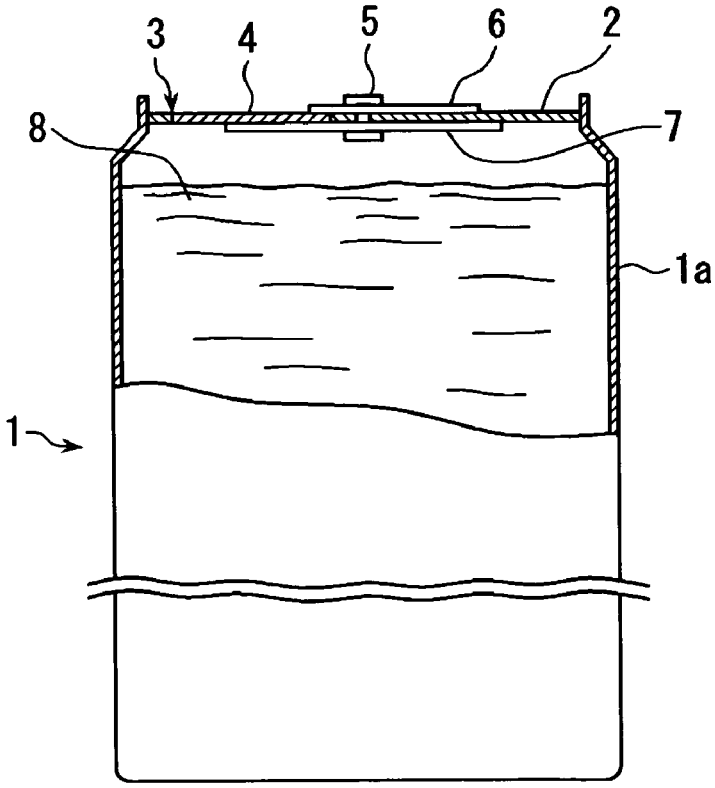

As shown in FIGS. 1 and 2, a can 1 of this embodiment has a spout 3 which is opened by lifting and pulling a pull-ring 6 fixed on a top wall 2 of a can body 1*a* with a rivet 5 to bend a sealing tongue portion 4 toward an inside of the can body 1*a*. On a position inside the top wall 2 and away from the spout 3, an internal sealing member 7 having a size capable of sealing the spout 3 and a fan shape with its pivot mounted to the rivet 5 is disposed in a fixed manner. As an interlocking mechanism to rotate the internal sealing member 7 at the time when the pull-ring 6 is rotated around the rivet 5, provided is a mechanism such that a base end of the pull-ring 6 and the pivot of the internal sealing member 7 are fixed to the rivet 5 on outer and inner sides of the top wall 2, respectively, and, after opening the spout 3, the rivet 5 is rotatably supported on the top wall 2.

Figure 3:
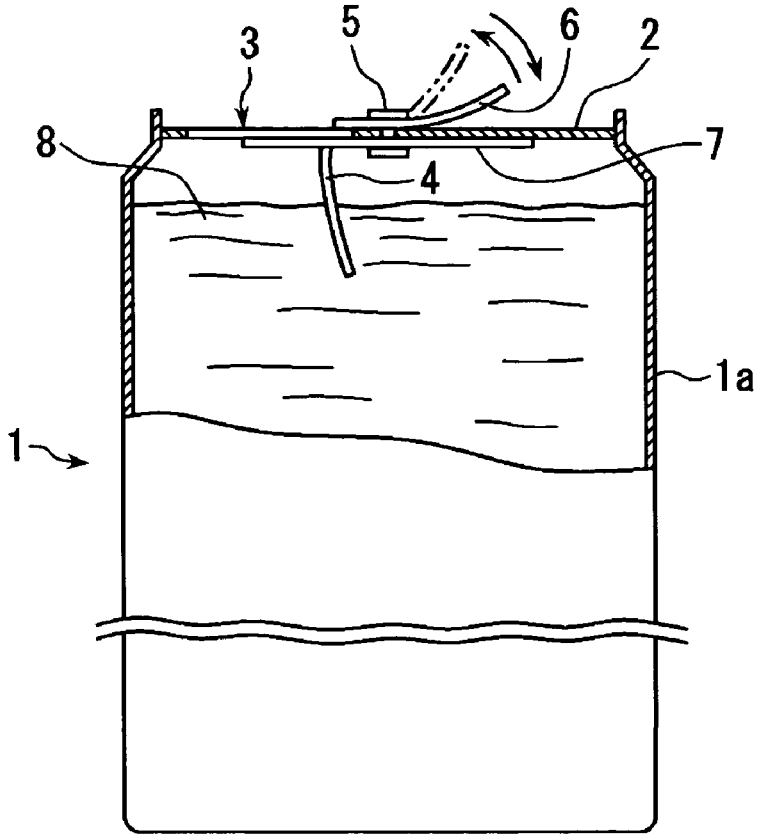
Figure 4:
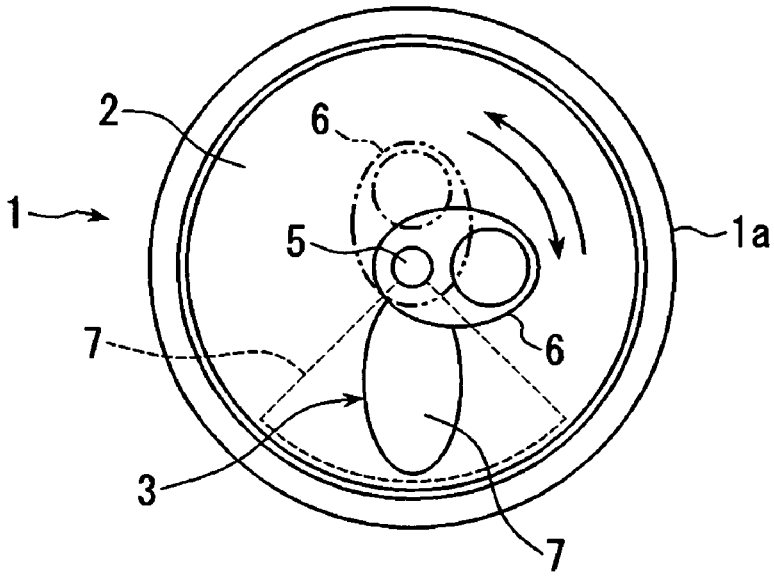
Figure 5:
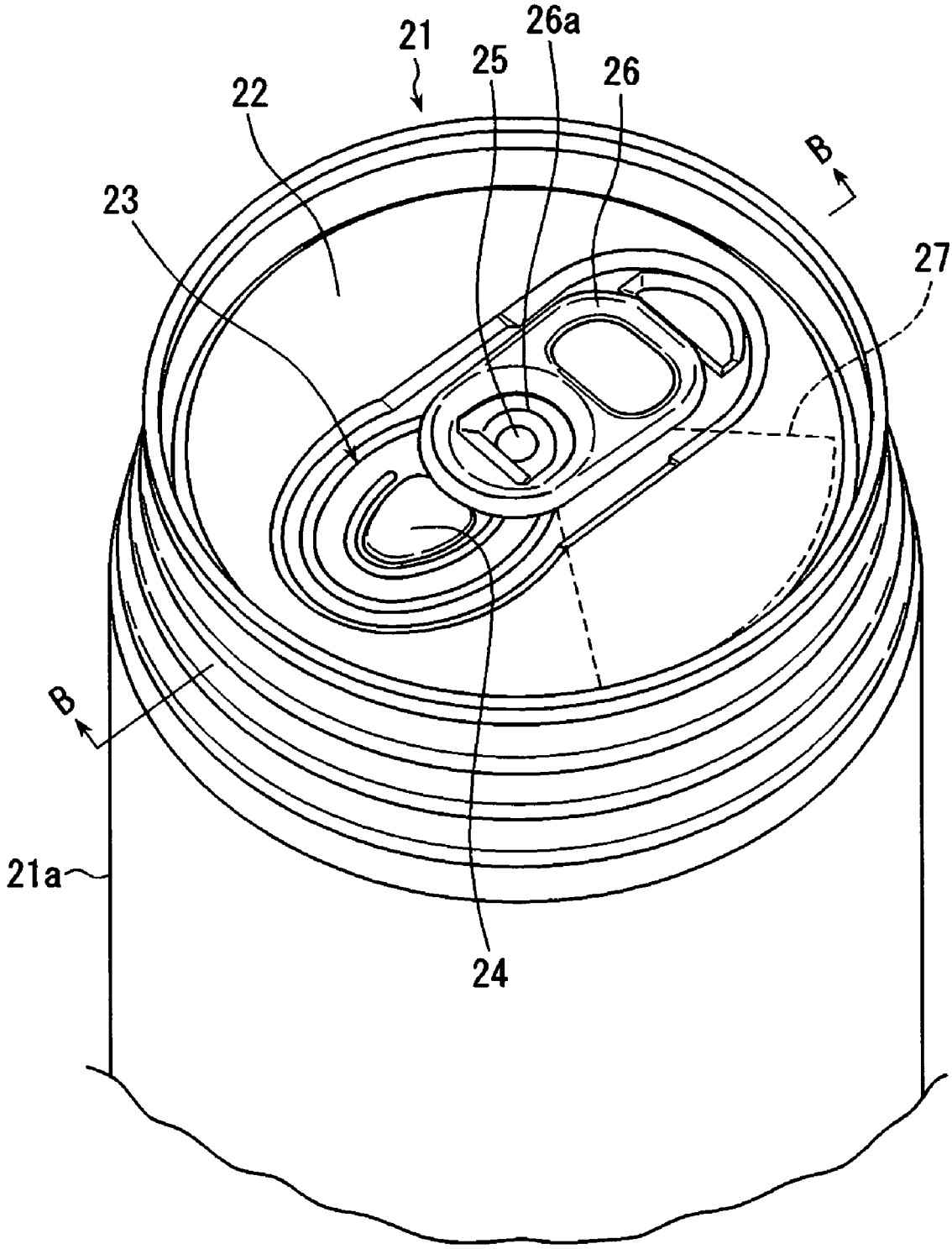
Figure 6:
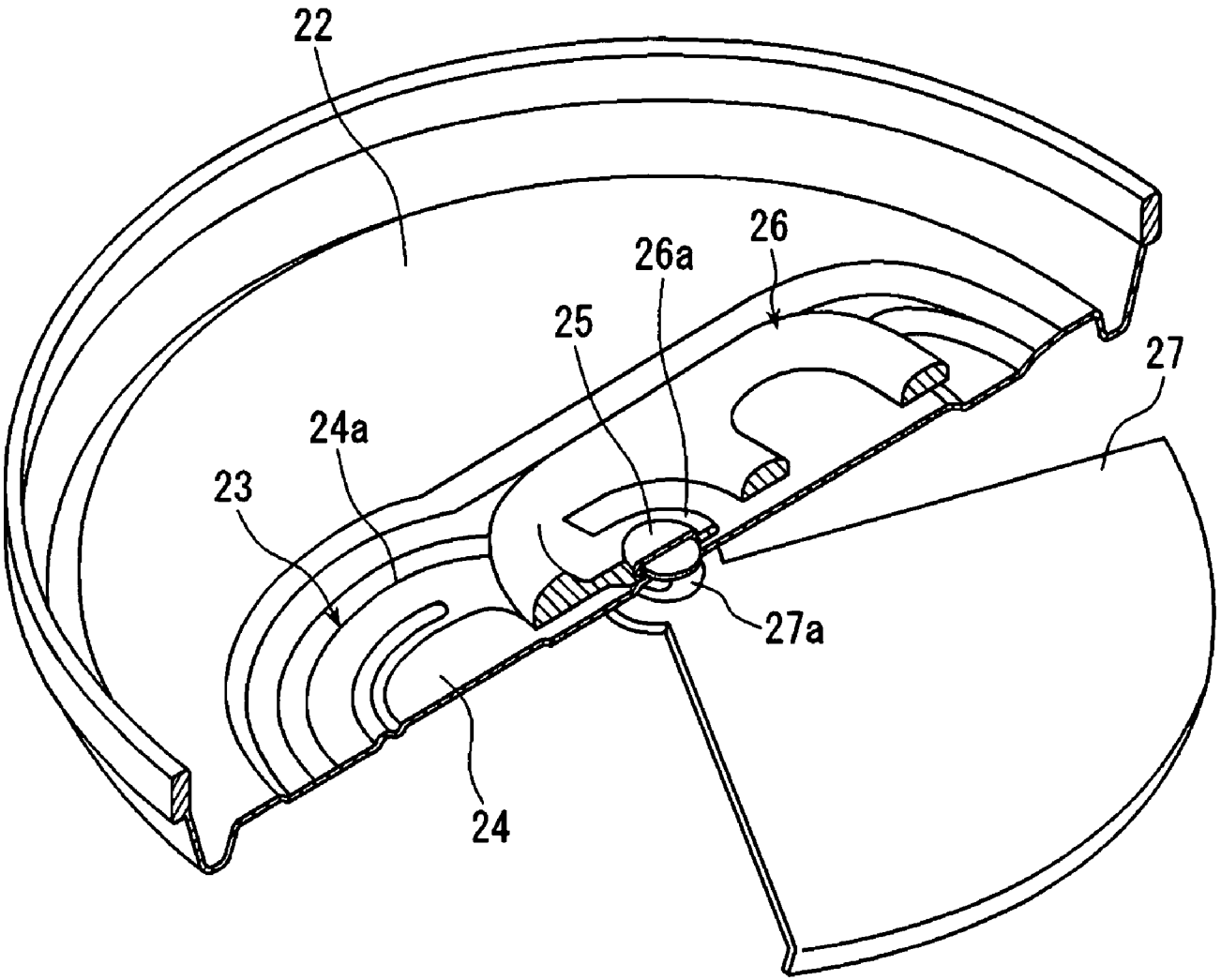
Figure 7:
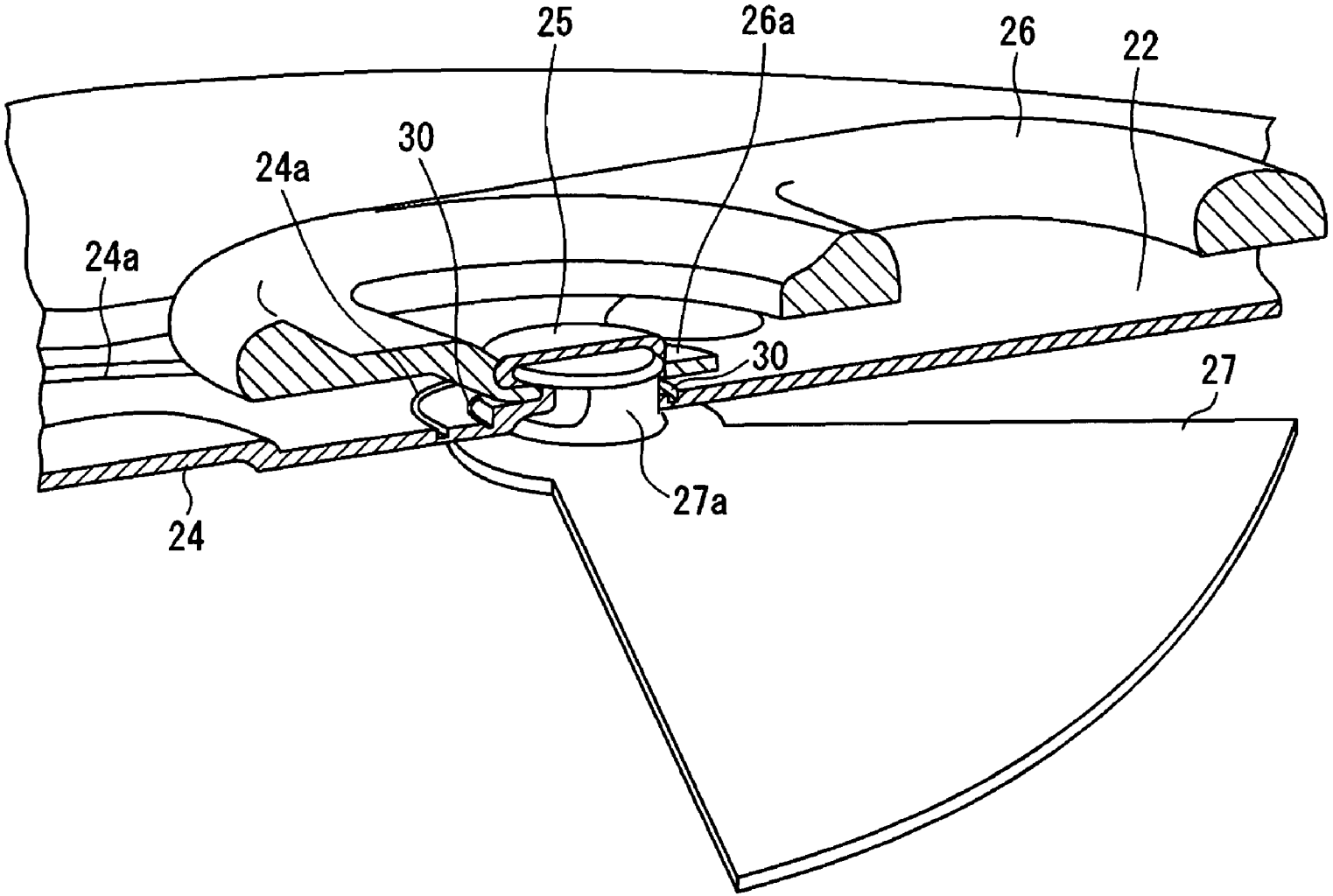

Referring to FIGS. 3 and 4, an opening operation of the can 1 and sealing and opening operations of the spout 3 thereafter will be described below. As shown in FIG. 3, when the pull-ring 6 is lifted and pulled by the same operation as in opening a conventional can having a pull-ring opener, the sealing tongue portion 4 is bent toward the inside of the can body 1*a* to open the spout 3. Thus, as in a conventional manner, after the raised pull-ring 6 is collapsed again on an outer side of the top wall 2, contents 8 can be drunk with the mouth against the spout 3 or poured from the spout 3.

After opening the spout 3, the rivet 5 is rotabably supported on the top wall 2 and, as shown in FIG. 4, by rotating the pull-ring 6 clockwise around the rivet 5, the internal sealing member 7 is also rotated in the same direction at the same time. When the internal sealing member 7 is rotated up to a position right beneath the spout 3, the spout 3 after opening can be sealed again. In this case, as shown in FIG. 3, the sealing tongue portion 4 bent toward the inside of the can by the opening operation is being hung from a left-hand part of the rivet 5 to the inside of the can. Therefore, when rotating the pull-ring 6 clockwise, if the internal sealing member 7 is rotated up to a position to abut against the sealing tongue portion 4, the internal sealing member 7, which has a fan shape with the pivot mounted to the rivet 5, is positioned right beneath the spout 3 to completely seal the spout 3. In other words, as the sealing tongue portion 4 bent toward the inside of the can functions as a stopper for the internal sealing member 7 moved to close the spout 3, the sealing condition can be easily confirmed by rotating the internal sealing member 7 up to the position to abut against the sealing tongue portion 4.

The internal sealing member 7 that has closed the spout 3 as the operation described above seals the spout 3 from the inner side of the top wall 2. Accordingly, if the can is shaken or drops, the contents 8 do not spill out. Furthermore, the spout 3 sealed by the internal sealing member 7 hinders heat exchange between the inner and outer sides of the can 1 to control a temperature change of the contents 8 of the can 1. As a result, if the contents 8 is a cold beverage, it can be kept cold, and if the contents 8 is a hot beverage, it can be kept hot for a relatively long time.

When the contents 8 are carbonated drinks such as beer or soda, a pressure inside the can 1 increases due to the carbon dioxide allowing the internal sealing member 7 to press itself against the spout 3. The airtightness is thus increased, thereby securely resealing the spout 3 after opening. Moreover, loss of carbon dioxide from the content 8 or the carbonated drink can be prevented.

Next, to reopen the spout 3 closed by the internal sealing member 7, as shown in FIG. 4, the pull-ring 6 is rotated around the rivet 5 counterclockwise. With this operation, the internal sealing member 7 is also rotated in the same direction at the same time and moves to a position away from the position right beneath the spout 3. Thus, the spout 3 can be easily opened. Accordingly, the spout 3 can be closed and opened simply by rotating the pull-ring 6 around the rivet 5 clockwise and counterclockwise, respectively, which makes the close/open operations extremely easy. In the can 1, the internal sealing member 7 is formed in a fan shape with the pivot mounted on the rivet 5. This particular shape, which does not disturb the opening operation of the spout 3 and also the closing operation even with the sealing tongue portion 4 hung from the spout 3, enables the spout 3 to be securely resealed by an easy operation by simply rotating the pull-ring 6.

In the can 1, the internal sealing member 7 is made of substantially the same material as the material of the can body 1*a*. Specifically, as the can body 1*a* is made of aluminum, the internal sealing member 7 is made of alumina base alloy. Thus, as the material of the can body 1*a* and the material of the internal sealing member 7 are substantially the same, the internal sealing member 7 can be mounted in a process similar to a conventional process for manufacturing a can, which prevents the manufacturing process from becoming complex. Also when recycling the can 1 that has been used, it is not necessary to separate the internal sealing member 7 from the can body 1*a*. In the case in which the can body 1*a* is made of steel, it is preferable to make the internal sealing member 7 of steel base alloy.

The can 1 of the present embodiment is a cylindrical can which is commercially distributed as a can for beer or the like. However, the present invention is not restricted to the form and is applicable to any kind of can with a pull-ring (pull top, pull tab) opener regardless of the shape, size, material and content thereof.

FIGS. 5 to 13 are drawings showing a second embodiment of the present invention.

As shown in FIGS. 5 to 8, a can 21 of this embodiment has a spout 23 which is opened by lifting and pulling a pull-ring 26 fixed to a projection 25 formed on substantially a center of a top wall 22 of a can body 21*a* to bend a sealing tongue portion 24 toward an inside of the can body 21*a*. On a position inside the top wall 22 and away from the spout 23, an internal sealing member 27 having a size capable of sealing the spout 23 and a fan shape is disposed to be fixed to the projection 25.

Figure 9:
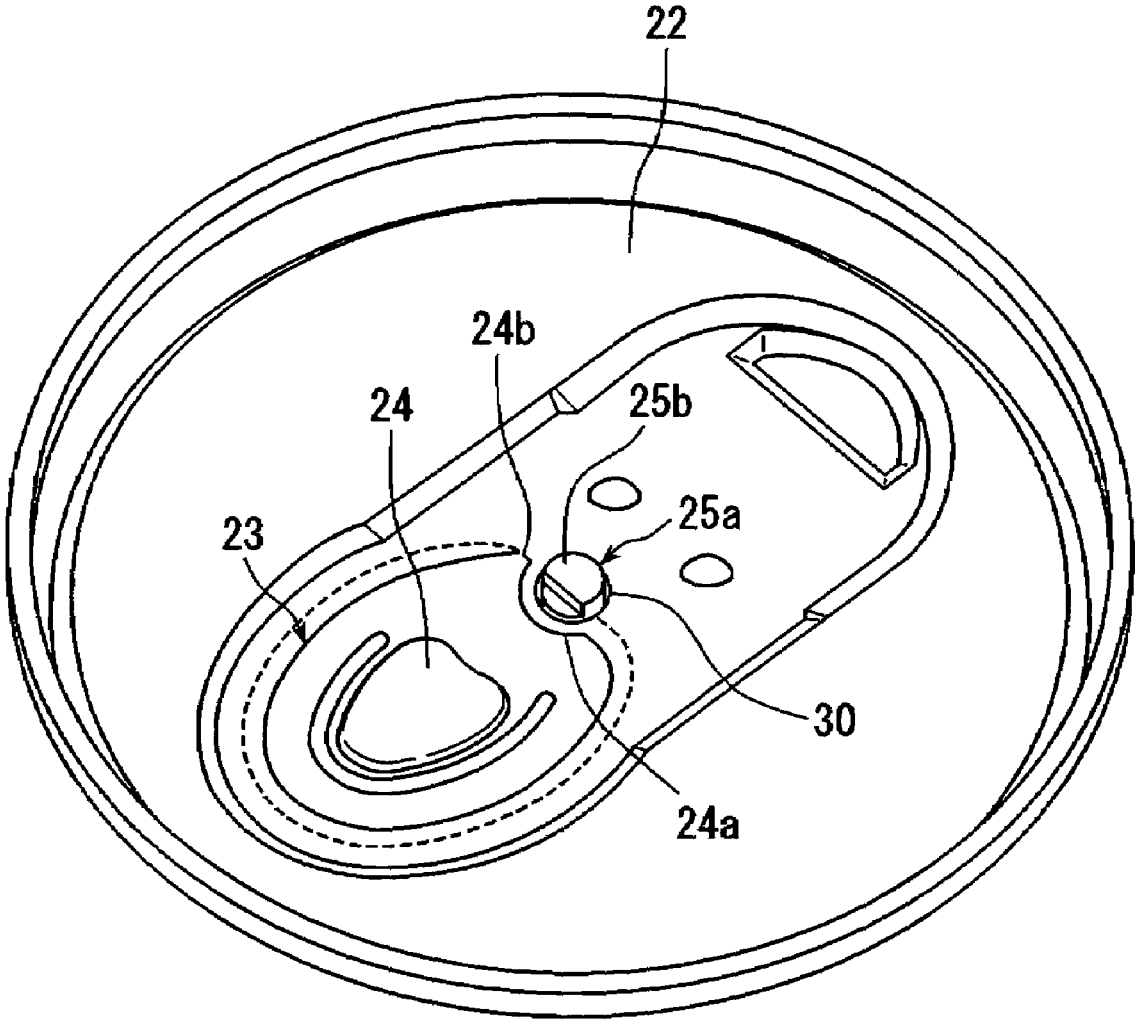
Figure 10:
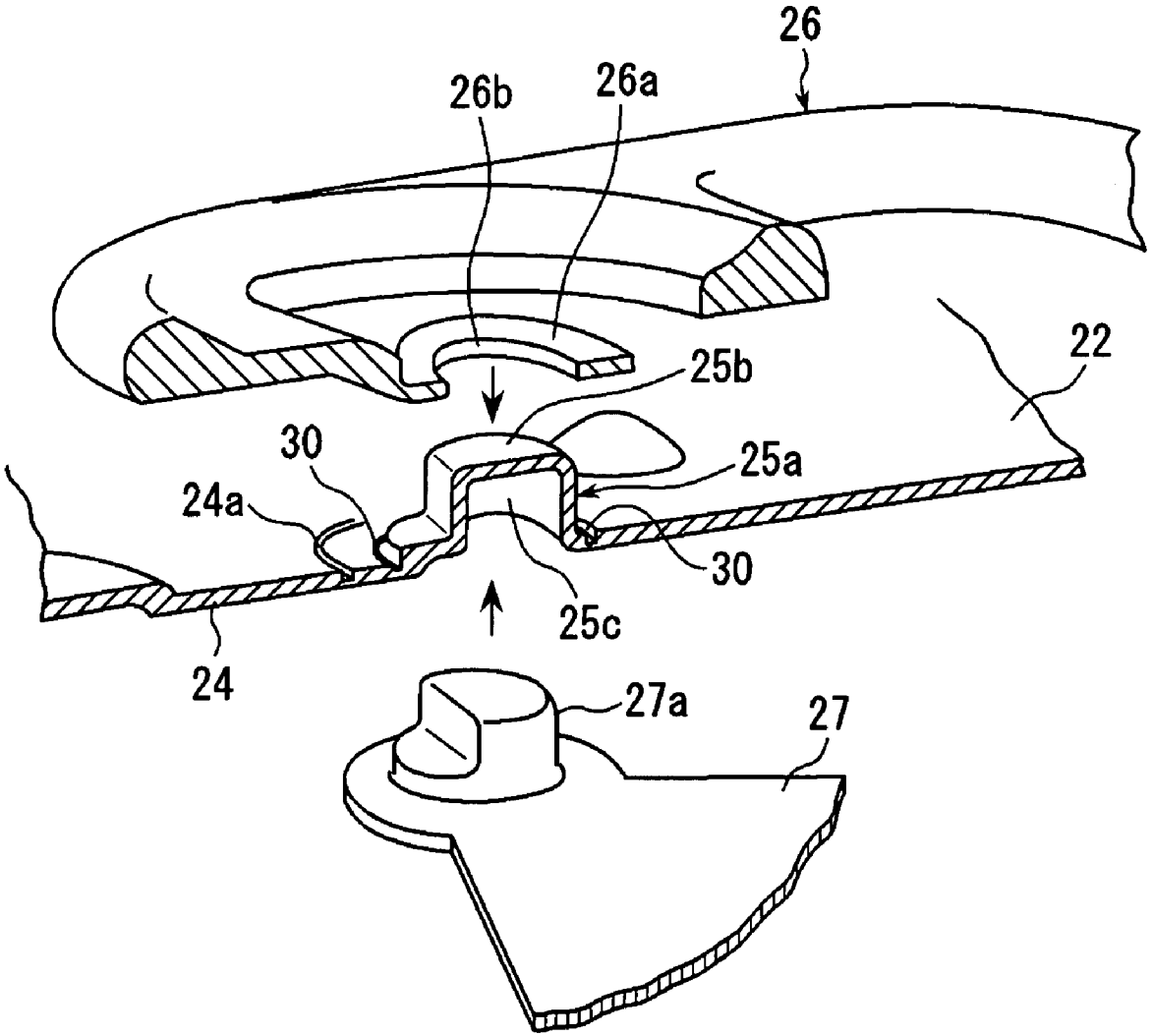

Referring to FIGS. 9 and 10, a structure for fixing the pull-ring 26 and the internal sealing member 27 to the projection 25 will be described below. As shown in FIG. 9, a hat-like pre-pressed projection 25*a* having an approximately semi lunar form in a plan view is formed at a substantially central position of the top wall 22 before assembly. As shown in FIG. 10, a hat-like projection 27*a* having an approximately semi lunar form in a plan view which is formed on a pivot of the fan-shaped internal sealing member 27 is inserted into a lower concave portion 25*c* formed on a rear side of the pre-pressed projection 25*a*. At the same time, a fixing member 26*a* formed in the pull-ring 26, having a substantially semi lunar-formed through hole 26*b*, is mounted to an upper convex portion 25*b* of the pre-pressed projection 25*a*.

Figure 8:
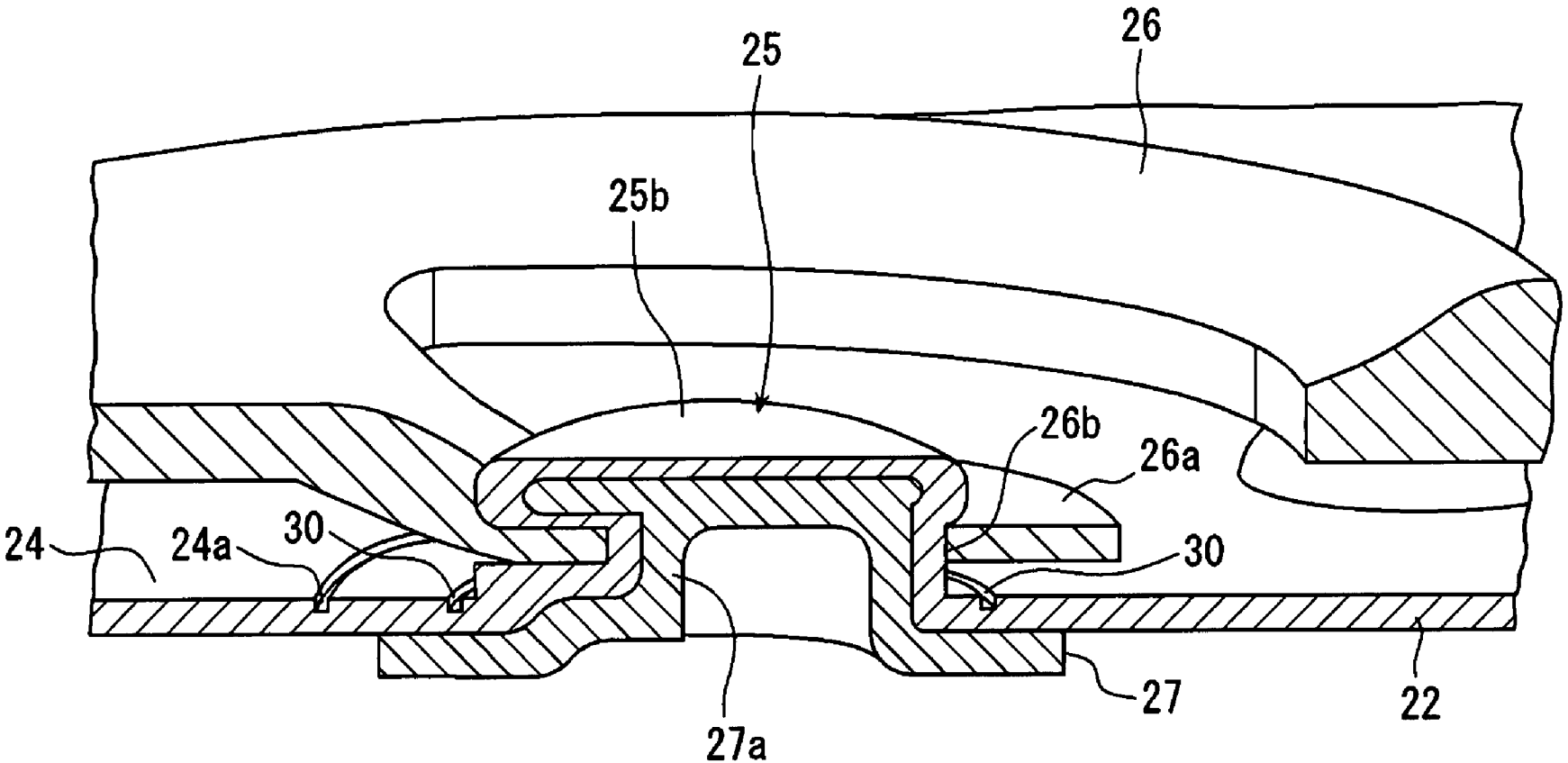

Next, the upper convex portion 25*b* of the pre-pressed projection 25*a* and the projection 27*a*of the internal sealing member 27 are pressed. Then, as shown in FIG. 8, the pre-pressed projection 25*a* of the top wall 22 and the projection 27*a* of the internal sealing member 27 are deformed to cause their diameters to be overlapping with each other. Thus, the fixing member 26*a* of the pull-ring 26 and the projection 27*a* of the internal sealing member 27 are fixed to the projection 25 of the top wall 22.

Referring to FIG. 9 and FIGS. 11 to 13, an opening operation of the spout 23 and the closing operation of the spout 23 using the internal sealing member 27 will be described below. As shown in FIG. 9, on an upper side of the top wall 22, a score line 24*a* and a hinge 24*b* are formed so that the sealing tongue portion 24 is bent toward the inside of the can body when lifting and pulling the pull-ring 26. A thin-walled portion 30 having a groove shape that is torn by a stress concentrated thereon when the pull-ring 26 is lifted and pulled is formed around the projection 25 drawing a closed circular curve surrounding the projection 25.

Figure 11:
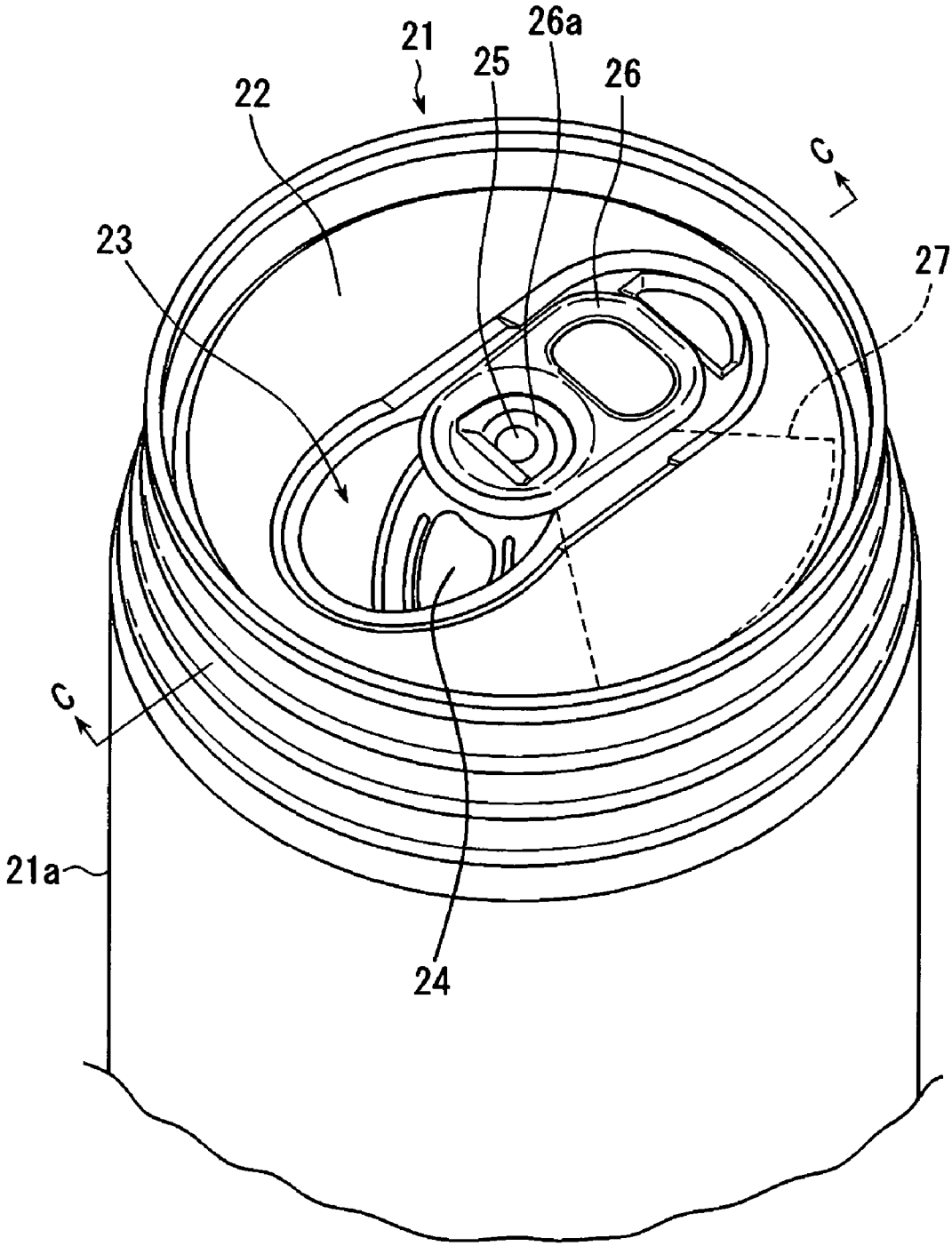

Consequently, when the pull-ring 26 is lifted and pulled in the same manner as the manipulation for opening the conventional cans with pull-ring openers, the score line 24*a* is torn and the hinge portion 24*b* is bent so that the sealing tongue portion 24 is bent toward the inside of the can body 21*a*, thereby to open the spout 23. Thereafter, by pushing back the pull-ring 26 onto the upper surface of the top wall 22 in a conventional manner, the can is opened as shown in FIG. 11. Thus, the contents of the can can be consumed with the mouth against the spout 23 or poured out through the spout 23. During such operations, the internal sealing member 27, which lies at a position away from the spout 23, does not disturb the drinking or pouring out of the contents from the spout 23.

Figure 12:
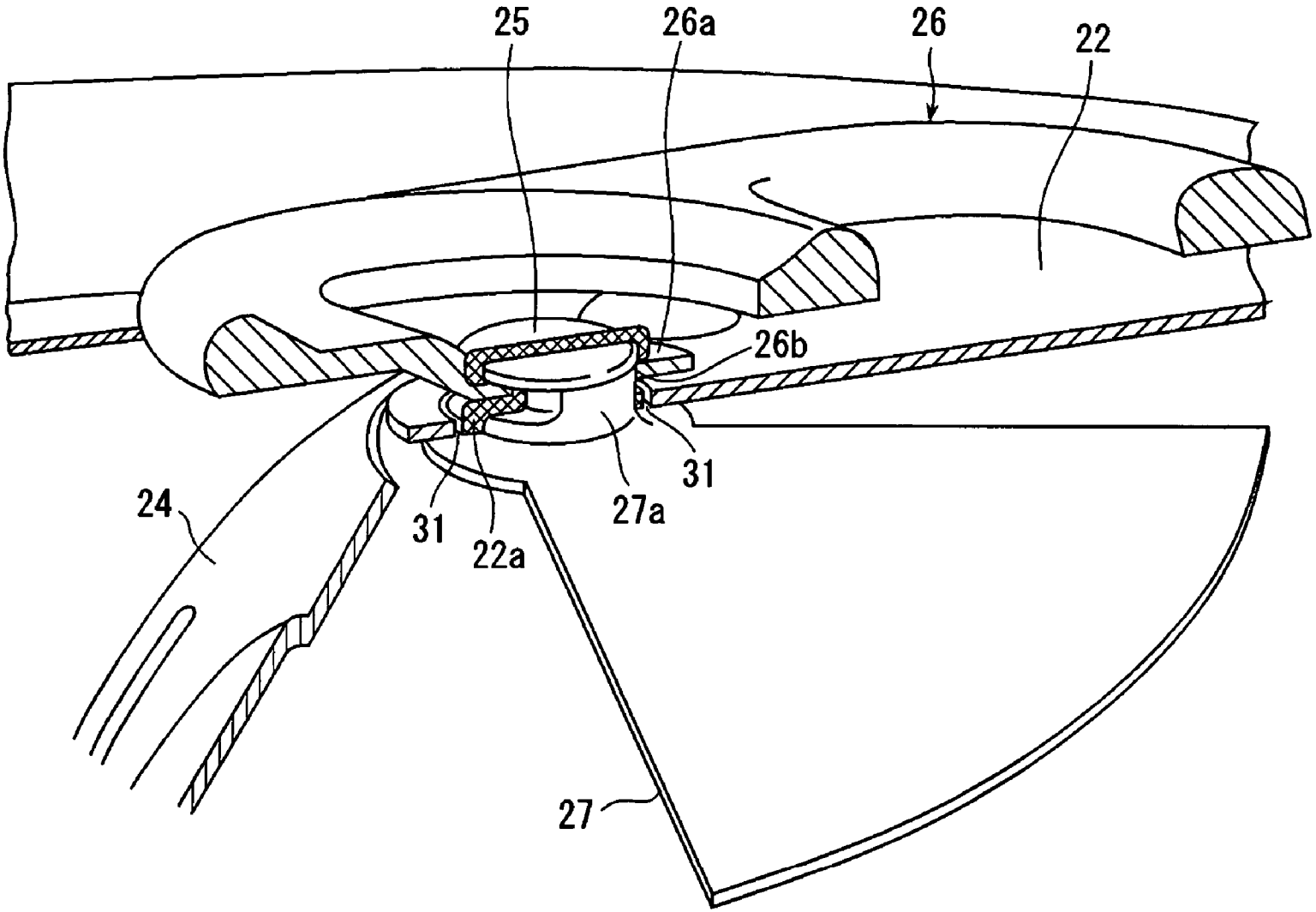
Figure 13:
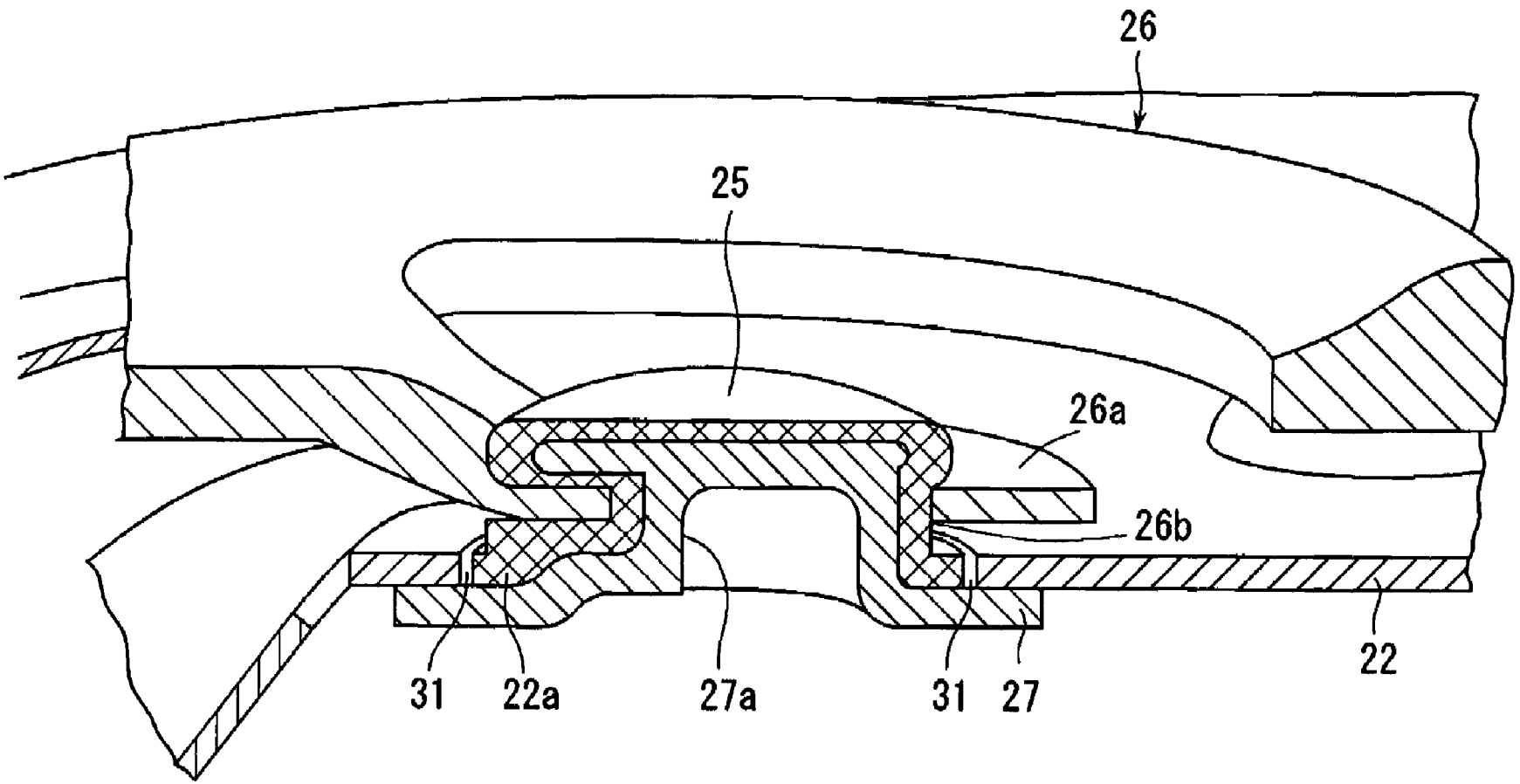

When opening the spout 23 as above, as shown in FIGS. 12 and 13, the circular thin-walled portion 30 surrounding the projection 25 is torn to form a gap 31 having a circular form. This makes the projection 25 (shown by a hatching 22*a*) released from the top wall 22. Thus, the fixing member 26*a* of the pull-ring 26 and the projection 27*a* of the internal sealing member 27 can be rotated free from the top wall 22 in a state integrally fixed to the projection 25. Accordingly, when rotating the pull-ring 26 around the projection 25 with the spout 23 opened, the interlocking mechanism to rotate the internal sealing member 27 at the same time is exerted.

As shown FIG. 10, the through hole 26*b* in the fixing member 26*a* of the pull-ring 26, the projection 27*a* of the internal sealing member 27, and the projection 25 are mounted with their substantially semi lunar portions to be oriented in the same direction. Therefore, whenever the pull-ring 26 is rotated, the internal sealing member 27 is also rotated without idling.

As described above, when the pull-ring 26 is rotated clockwise around the projection 25, the internal sealing member 27 is rotated to the same direction at the same time, and the spout 23 after it is opened can be resealed by rotating the internal sealing member 27 up to a position right beneath the spout 26. In this case, as shown in FIGS. 12 and 13, the sealing tongue portion 24 bent toward the inside of the can body 21*a* by the opening operation is being hung from the hinge 24*b* (FIG. 9) adjacent to the projection 25 to the inside of the can body 21*a*.

Therefore, by rotating the pull-ring 26 clockwise until the internal sealing member 27 abuts against the sealing tongue portion 24, the internal sealing member 27 comes to a position right beneath the spout 23 to completely seal the spout 23 securely. In other words, as the sealing tongue portion 24 hung toward the inside of the can body 21*a* functions as a stopper for the internal sealing member 27 moved to close the spout 23, the sealing condition can be easily confirmed by rotating the internal sealing member 27 until the internal sealing member 27 abuts against the sealing tongue portion 24.

The internal sealing member 27 that has closed the spout 23 as the operation described above seals the spout 23 from the inner side of the top wall 22. Accordingly, if the can is shaken or dropped, the content will not spill out. Furthermore, the spout 23 sealed by the internal sealing member 27 hinders heat exchange between the inner and outer sides of the can 21 to control a temperature change of the content of the can 21. As a result, a cold beverage can be kept cold while a hot beverage can be kept hot for a relatively long time.

In the case that the content is a carbonated drink such as beer or soda, a pressure inside the can 21 increased due to carbon dioxide allows the internal sealing member 27 to press itself against the spout 23. The airtightness is thus increased, thereby securely resealing the spout 23 after opening. As a result, loss of carbon dioxide from the content or the carbonated drink can be prevented.

Next, to reopen the spout 23 closed by the internal sealing member 27, as shown in FIG. 4 explained above, the pull-ring 26 is rotated around the projection 25 counterclockwise. With this operation, the internal sealing member 27 is also rotated in the same direction at the same time and moves to a position away from the position right beneath the spout 23. Thus, the spout 23 can be easily opened.

In this manner, the spout 23 after it is opened can be closed and opened simply by rotating the pull-ring 26 around the projection 25 clockwise and counterclockwise, respectively, which makes the close/open operations extremely easy.

In the can 21, the internal sealing member 27 is formed in a fan shape with the pivot mounted on the projection 25. The shape, which does not disturb the closing operation even with the sealing tongue portion 24 hung from the spout 23 toward the inside of the can, enables the spout 3 to be securely resealed.

As in the can 1 of the first embodiment, the can body 21*a*, the top wall 22 and the internal sealing member 27 that constitute the can 21 are made of alumina base alloy. Therefore, the internal sealing member 27 can be mounted in the same manufacturing process as the conventional process to manufacture a can, which does not lead to complexity in the process. Furthermore, on recycling the can 21 that has been used, it is not necessary to separate the internal sealing member 27 from the can body 21*a* and other members. When the can body 21*a* is made of steel, it is preferable to make the internal sealing member 27 of steel base alloy as well.

The can 21 of the present embodiment is a cylindrical can which is commercially distributed as a can for beer or the like. However, the present invention is not restricted to this form and is widely applicable to any kind of can with a pull-ring (pull top, pull tab) opener regardless of the shape, size, material and content thereof.

Figure 14:
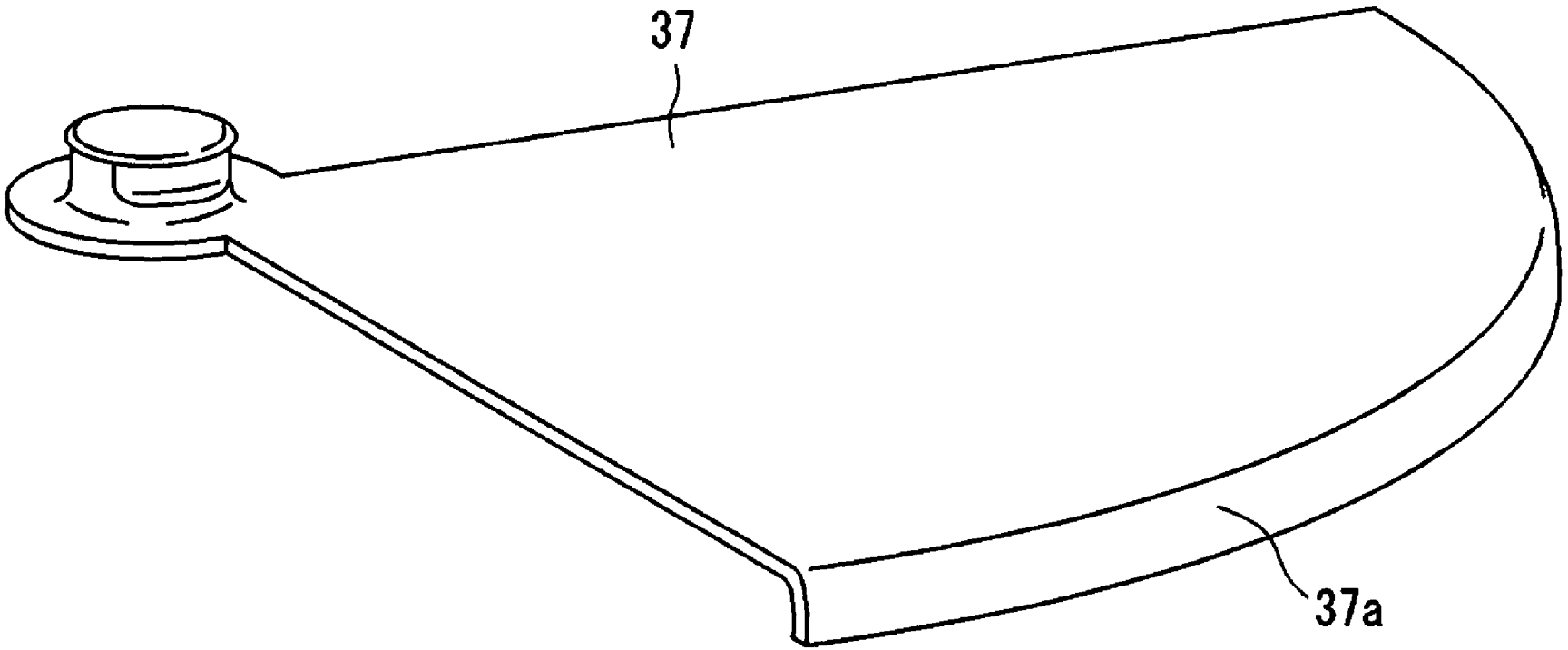
FIGS. 14 and 15 are perspective views showing additional embodiments of the internal sealing member.

Next, with reference to FIGS. 14 and 15, another embodiment of an internal sealing member will be described below. An internal sealing member 37 shown in FIG. 14 has the same form as the form of the above-described internal sealing member 27 if taken as a plan view, but is provided with a skirt 37*a* extending downwardly from an arc portion of the internal sealing member 37. With this skirt 37*a*, the strength (rigidity) of the internal sealing member 37 is increased, and also the sealing effect of a spout is enhanced because the skirt 37*a* is positioned at a corner portion where a top wall and a can body are connected. The configuration and function of the remaining members are the same as those of the internal sealing member 27.

Figure 15:
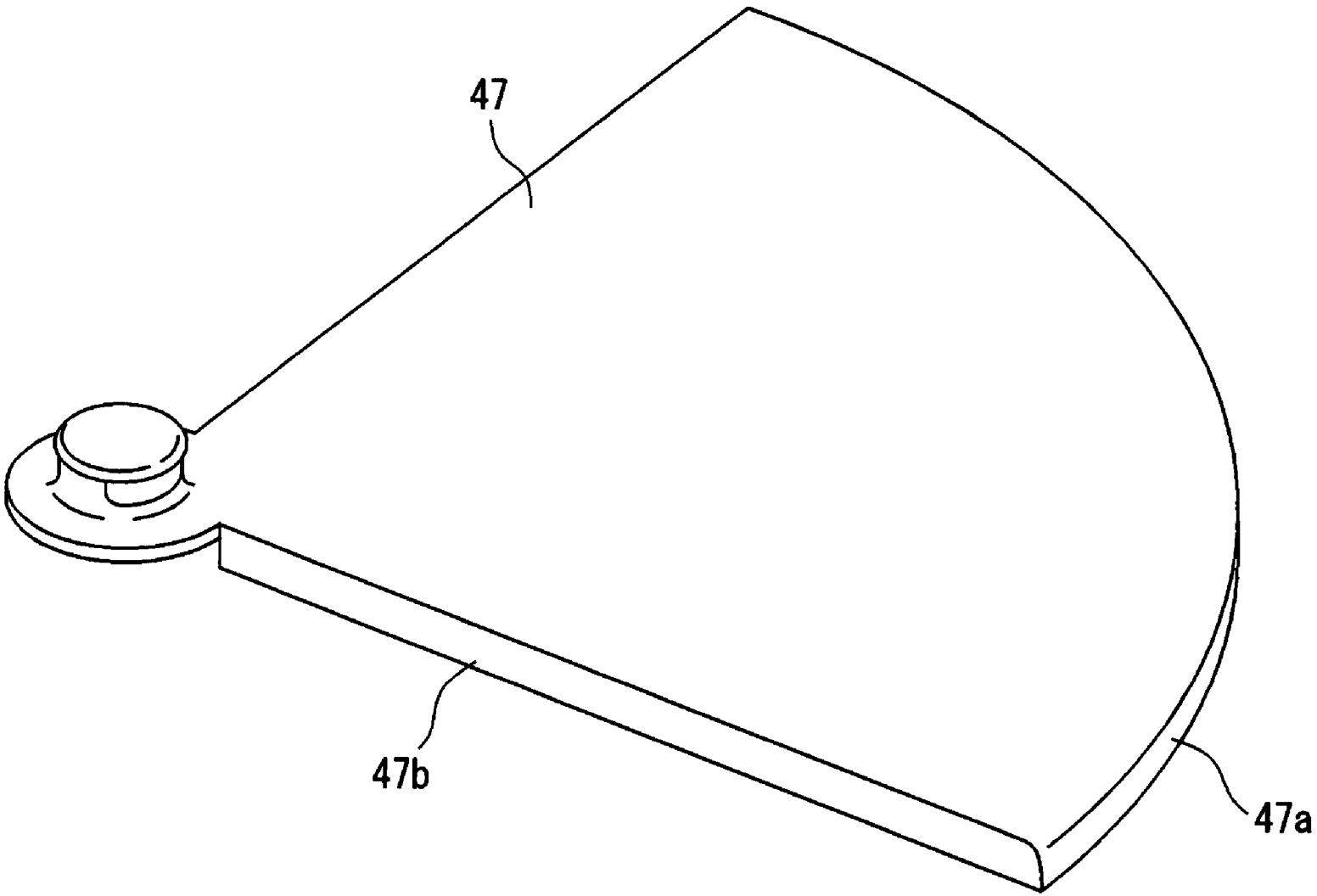

An internal sealing member 47 shown in FIG. 15 is provided with a skirt 47*a* on an arc portion thereof as well as a skirt 47*b* formed along radial edges. With this structure, when closing a spout after opening a can with the internal sealing member 47, if the internal sealing member 47 is rotated by mistake with fingers or the like being inserted into the spout, the skirt 47*b* having a flat form abuts against the fingers or the like at its flat portion to prevent the fingers or the like from being injured, resulting in higher safety. The function and effect of the skirt 47*a* are the same as those of the skirt 37*a* as described above, and the configuration and function of the remaining member are the same as those of the internal sealing member 27.

With reference to FIGS. 16 to 19, additional embodiments of a top wall will be described below.

Figure 16:
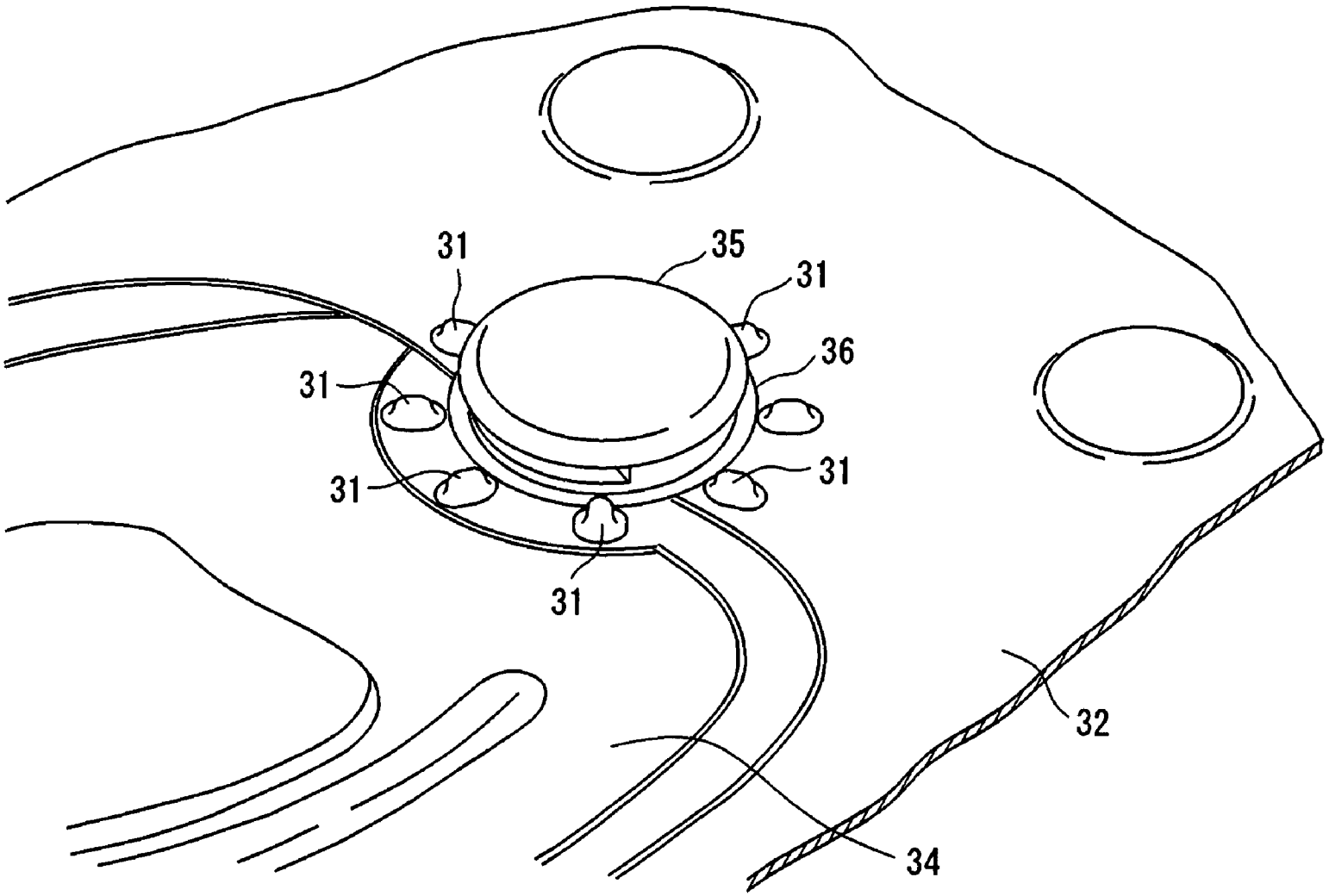
FIG. 16 is a partial perspective view showing another embodiment of the top wall.
Figure 17:
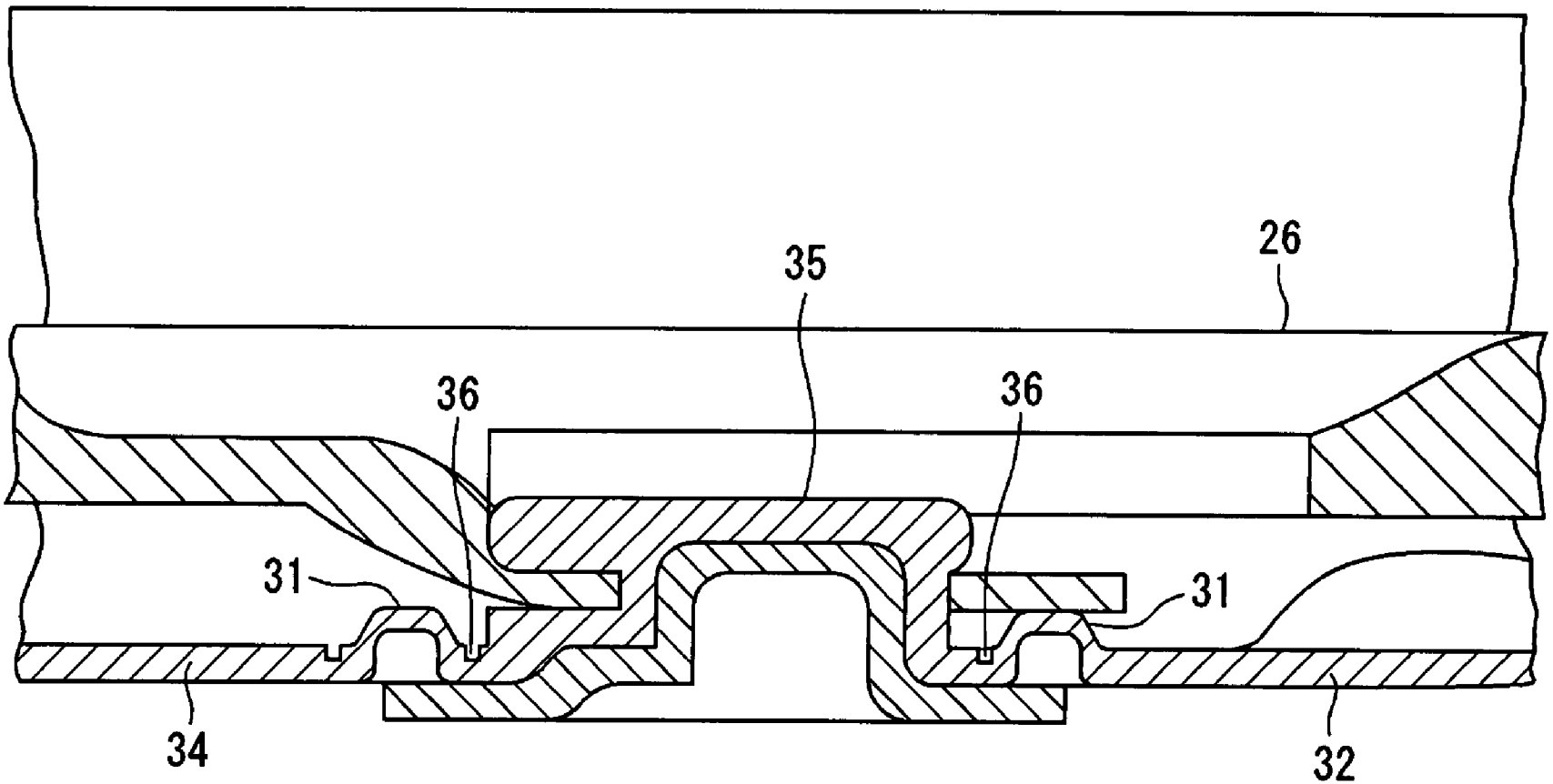
FIG. 17 is a partial sectional view illustrating a can employing the top wall shown in FIG. 16.

A top wall 32 shown in FIGS. 16 an 17 is provided with a plurality of convex portions 31 projecting toward an outer surface of the top wall 32 in an area between a circular thin-walled portion 36 surrounding a projection 35 and a sealing tongue portion 34 on the top wall 32. These convex portions 31 are arranged with equal intervals therebetween around the thin-walled portion 36. With this structure, the rigidity of the top wall 32 in the area between the thin-walled portion 36 and the sealing tongue portion 34 is increased. Accordingly, when lifting and pulling the pull-ring 26 by a normal opening operation, a stress is concentrated onto the thin-walled portion 36 to certainly break the thin-walled portion 36 that should be torn, which facilities an opening operation.

Figure 18:
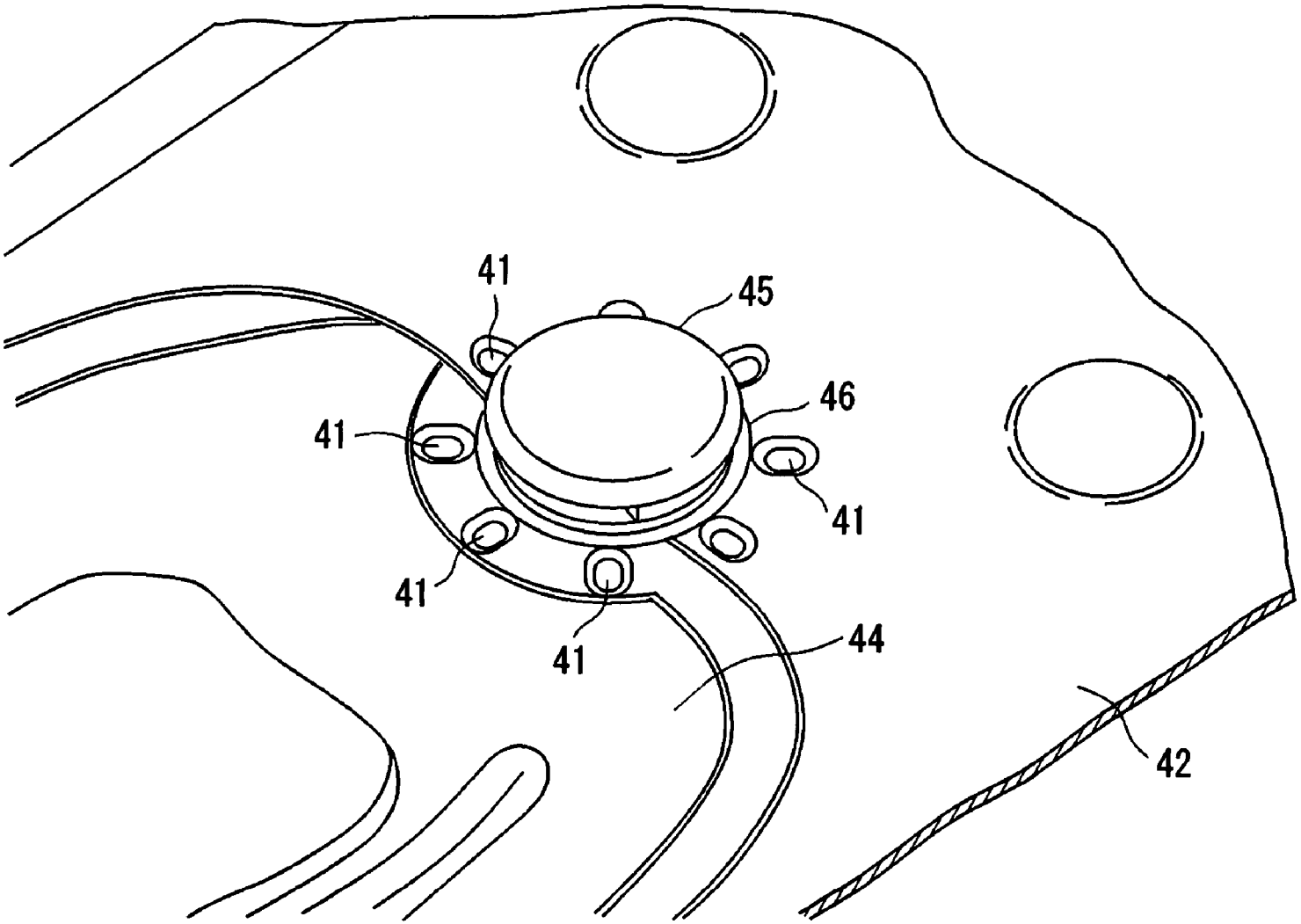
FIG. 18 is a partial perspective view showing yet another embodiment of the top wall.
Figure 19:
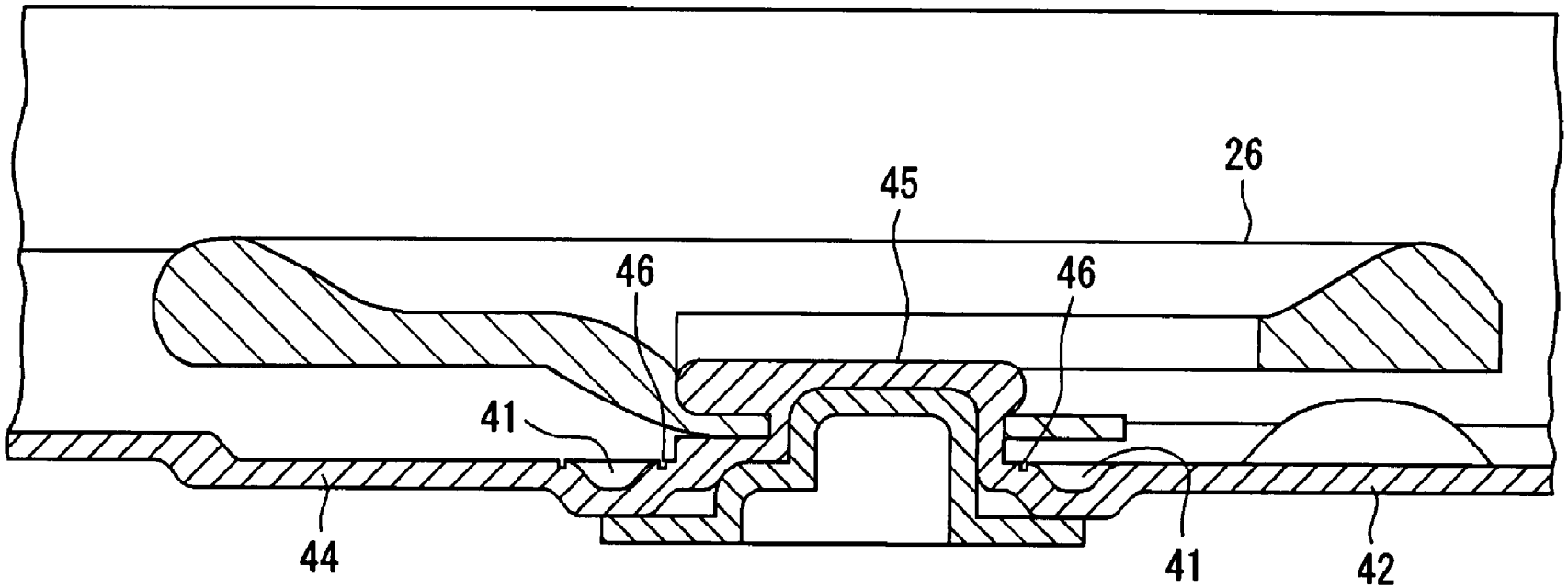
FIG. 19 is a partial sectional view illustrating a can employing the top wall shown in FIG. 18.

A top wall 42 shown in FIGS. 18 and 19 is provided with a plurality of concave portions 41 extending toward an inner surface of the top wall 42 in an area between a circular thin-walled portion 46 surrounding a projection 45 and a sealing tongue portion 44 on the top wall 42. These concave portions 41 are arranged with equal intervals therebetween around the thin-walled portion 46. With this structure, the rigidity of the top wall 42 in the area between the thin-walled portion 46 and the sealing tongue portion 44 is increased. Accordingly, when lifting and pulling the pull-ring 26 by a normal opening operation, as in the top wall 32 shown in FIGS. 16 and 17 described above, a stress is concentrated onto the thin-walled portion 46 to certainly break the thin-walled portion 46 that should be torn, which facilities an opening operation.

The convex portions 31 of the top wall 32 shown in FIG. 16 and the concave portions 41 of the top wall 42 are substantially the same in their functions and effects.

Preferably, either of these members may be employed depending on the structures of the top walls 32, 43, the pull-ring 26 and the projections 35, 45 and on the manufacturing process of the can.

Figure 20:
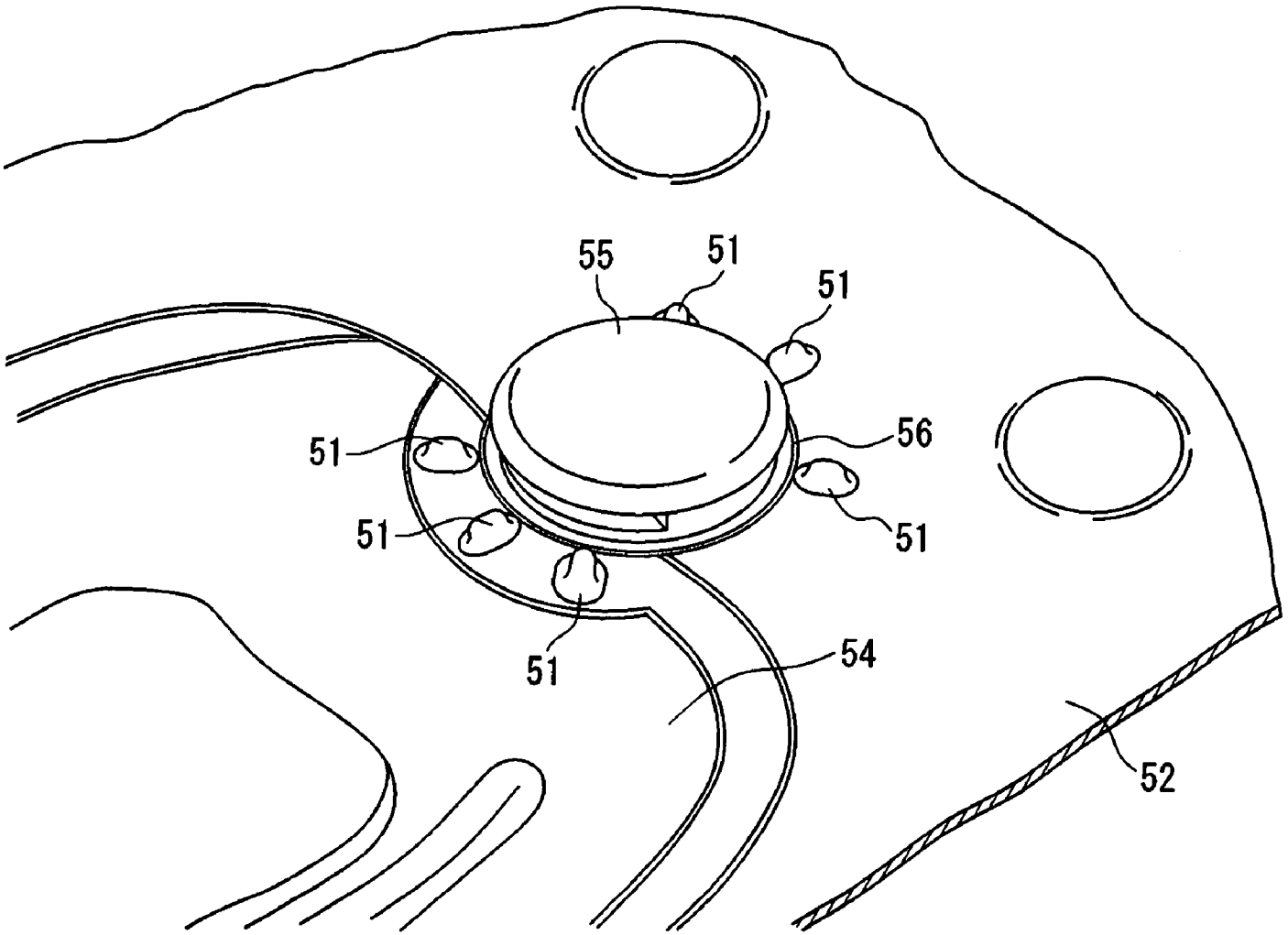
FIG. 20 is a partial perspective view showing yet another embodiment of the top wall.

Referring to FIG. 20, yet another embodiment of a top wall will be described below. A top wall 52 shown in FIG. 20 is provided with a plurality of convex portions 51 extending toward an outer surface of the top wall 52 in an area between a circular thin-walled portion 56 surrounding a projection 55 and a sealing tongue portion 54 on the top wall 52. A first group of the convex portions 51 are disposed, in a periphery of the thin-walled portion 36, in a position on a side of the sealing tongue portion 54. A second group of the convex portions 51 consisting of the same number of the first group of the convex portions 51 are disposed in symmetric relation to the first group with the projection 55 positioned at a center thereof.

The areas where these convex portions 55 are disposed are two of the most stressed area when lifting and pulling a pull-ring (not shown) and collapsing the pull-ring after opening an spout with normal operations. Thus, by increasing the rigidity of these areas with the convex portions 51, a stress is concentrated onto the thin-walled portion 56 around the projection 55 when lifting or collapsing the pull-ring 26 to open the spout, thereby to certainly break the thin-walled portion 56, further facilitating the opening operation.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. A can comprising:

a top wall with a dispensing opening that is normally closed by a sealing tongue portion;

a pull-ring for opening the dispensing opening, said pull-ring being fixed to a projection formed on the top wall of the can, wherein the dispensing opening can be opened by lifting and pulling the pull-ring to bend the sealing tongue portion toward an inside of the can;

an internal sealing member having a size capable of sealing the dispensing opening, the internal sealing member being fixed to the projection and disposed on a position inside of the top wall and away from the dispensing opening;

and an interlocking mechanism for rotating the internal sealing member at the time when the pull-ring is rotated around the projection after the dispensing opening is opened by bending the sealing tongue portion toward the inside of the can, wherein said interlocking mechanism is a thin-walled portion having a form of a closed curve that encircles the projection and is torn when the dispensing opening is initially opened by lifting and pulling the pull-ring.

2. The can according to claim 1, wherein, on an area of said top wall between the thin-walled portion and the sealing tongue portion, at least one selected from a convex portion extending toward an outer side of the top wall and a concave portion extending toward an inner side of the top wall is provided.

3. The can according to claim 1, wherein said internal sealing member is formed in a fan shape with a pivot mounted on said projection.

4. The can according to claim 1, wherein said internal sealing member is made of substantially the same material as a material of a body of the can.

5. The can according to claim 1, wherein a plurality of convex portions are formed in an area of said top wall between the thin-walled portion and the sealing tongue portion, the convex portions extend outwardly of the top wall.

6. The can according to claim 1, wherein a plurality of concave portions are formed in an area of said top wall between the thin-walled portion and the sealing tongue portion, the concave portions extend inwardly of the top wall.

7. The can according to claim 1, wherein the internal sealing member includes a projection that is received in the projection formed in the top wall, and the projections extend through a hole formed in the pull-ring.

8. A can comprising:

a top wall with a dispensing opening that is normally closed by a sealing tongue portion;

an opening device for opening the dispensing opening, said opening device being fixed to a projection formed on the top wall of the can, wherein the dispensing opening can be opened by lifting and pulling the opening device so as to bend the sealing tongue portion toward an inside of the can;

an internal sealing member having a size capable of sealing the dispensing opening, the internal sealing member being fixed to the projection and disposed on a position inside of the top wall and away from the dispensing opening;

and an interlocking mechanism for rotating the internal sealing member at the time when the opening device is rotated around the projection after the dispensing opening is opened by bending the sealing tongue portion toward the inside of the can, wherein said interlocking mechanism is a thin-walled portion having a form of a closed curve that encircles the projection and is torn when the dispensing opening is initially opened by lifting and pulling the opening device.

9. The can according to claim 8, wherein, on an area of said top wall between the thin-walled portion and the sealing tongue portion, at least one selected from a convex portion extending toward an outer side of the top wall and a concave portion extending toward an inner side of the top wall is provided.

10. The can according to claim 8, wherein said internal sealing member is formed in a fan shape with a pivot mounted on said projection.

11. The can according to claim 8, wherein said internal sealing member is made of substantially the same material as a material of a body of the can.

12. The can according to claim 8, wherein a plurality of convex portions are formed in an area of said top wall between the thin-walled portion and the sealing tongue portion, the convex portions extend outwardly of the top wall.

13. The can according to claim 8, wherein a plurality of concave portions are formed in an area of said top wall between the thin-walled portion and the sealing tongue portion, the concave portions extend inwardly of the top wall.

14. The can according to claim 8, wherein the internal sealing member includes a projection that is received in the projection of the top wall, and the projections extend through a hole formed in the pull-ring.

* * * * *